US012043445B2

(12) United States Patent
Derrien

(10) Patent No.: US 12,043,445 B2
(45) Date of Patent: Jul. 23, 2024

(54) CONTAINER, THE BODY OF WHICH HAS A GRIPPING HANDLE FORMED BY A SINGLE BOXING OPERATION

(71) Applicant: SIDEL PARTICIPATIONS, Octeville-sur-Mer (FR)

(72) Inventor: Mikaël Derrien, Octeville-sur-Mer (FR)

(73) Assignee: SIDEL PARTICIPATIONS, Octeville-sur-Mer (FR)

( * ) Notice: Subject to any disclaimer, the term of this patent is extended or adjusted under 35 U.S.C. 154(b) by 41 days.

(21) Appl. No.: 17/612,664

(22) PCT Filed: May 14, 2020

(86) PCT No.: PCT/EP2020/063526

§ 371 (c)(1),
(2) Date: Nov. 19, 2021

(87) PCT Pub. No.: WO2020/234125

PCT Pub. Date: Nov. 26, 2020

(65) Prior Publication Data

US 2022/0242616 A1 Aug. 4, 2022

(30) Foreign Application Priority Data

May 20, 2019 (FR) ..... 1905276

(51) Int. Cl.
*B65D 23/10* (2006.01)
*B65D 1/02* (2006.01)

(52) U.S. Cl.
CPC ..... *B65D 23/102* (2013.01); *B65D 1/0223* (2013.01); *B65D 2501/0036* (2013.01)

(58) Field of Classification Search
CPC ..... B65D 23/102; B65D 1/0223; B65D 2501/0036; B65D 23/106
USPC ..... 215/382–385
See application file for complete search history.

(56) References Cited

U.S. PATENT DOCUMENTS 1,770,093 A * 7/1930 West ..... B65D 1/0223 215/383
5,052,567 A * 10/1991 Colani ..... B65D 23/102 220/771
5,868,272 A 2/1999 Deal
(Continued)

FOREIGN PATENT DOCUMENTS

JP H0280515 U 6/1990
JP H0721540 U 4/1995
(Continued)

OTHER PUBLICATIONS

International search report dated Jul. 15, 2020.

*Primary Examiner* — Robert J Hicks
*Assistant Examiner* — Sanjidul Islam

(57) ABSTRACT

The invention relates to a plastic container comprising a body that extends along a central axis between an opening and a base, the body having an overstroked holding recess extending parallel to the central axis over a predetermined height, the overstroked holding recess being the only overstroked recess on the body over the predetermined height, and having a median line of maximum indentation, the median line of maximum indentation being able to be inscribed in a diametrical plane.

18 Claims, 6 Drawing Sheets

(56) References Cited

U.S. PATENT DOCUMENTS

| | | | | |
|---|---|---|---|---|
| 5,927,533 | A * | 7/1999 | Payne | B65D 23/102 215/381 |
| 2002/0074347 | A1 * | 6/2002 | Murray | B65D 81/3283 222/129 |
| 2004/0226904 | A1 | 11/2004 | Schroeder | |
| 2008/0308521 | A1 | 12/2008 | Caporaso | |
| 2018/0170616 | A1 * | 6/2018 | Usami | B29C 49/30 |

FOREIGN PATENT DOCUMENTS

| | | | |
|---|---|---|---|
| JP | 3138927 | U | 1/2008 |
| JP | 2017128348 | A | 7/2017 |
| WO | 2005094484 | A2 | 10/2005 |

* cited by examiner

[Fig. 1]
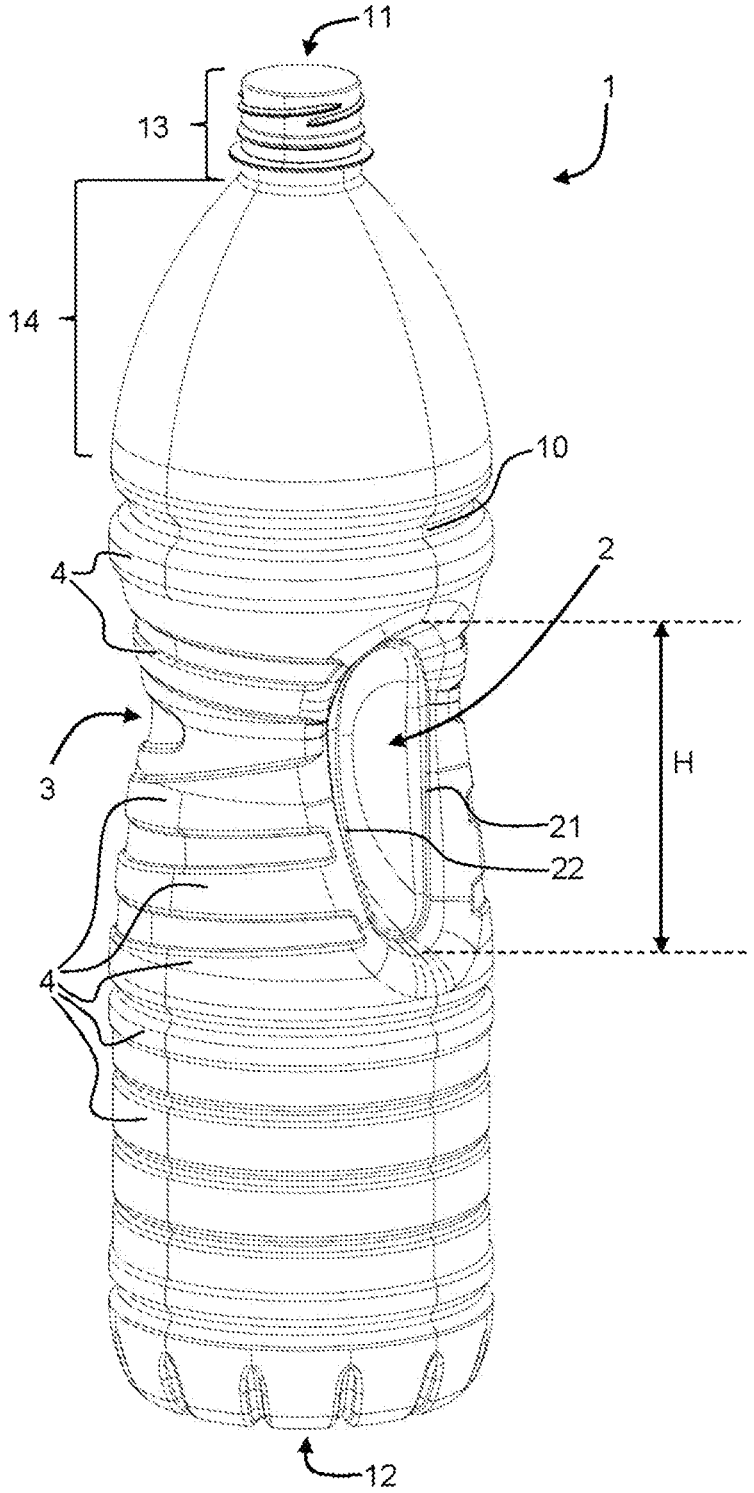

[Fig. 2]
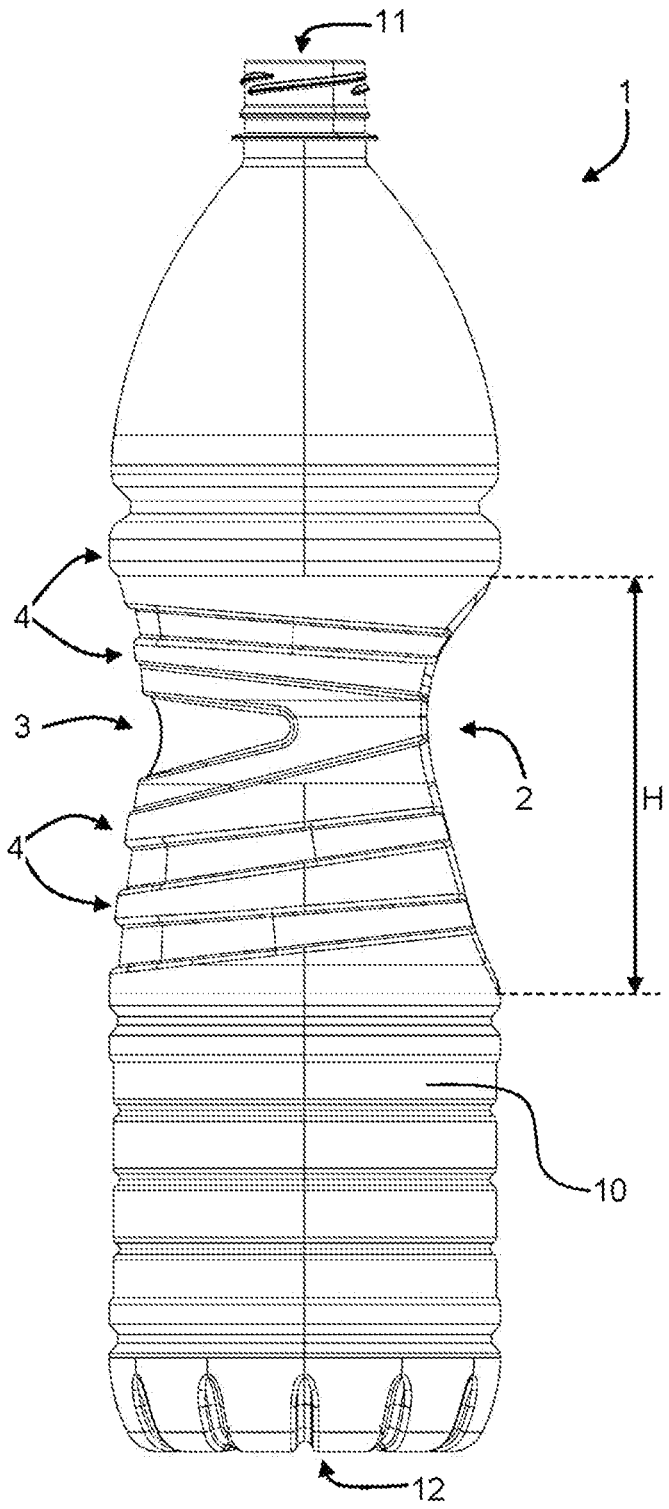

[Fig. 3]
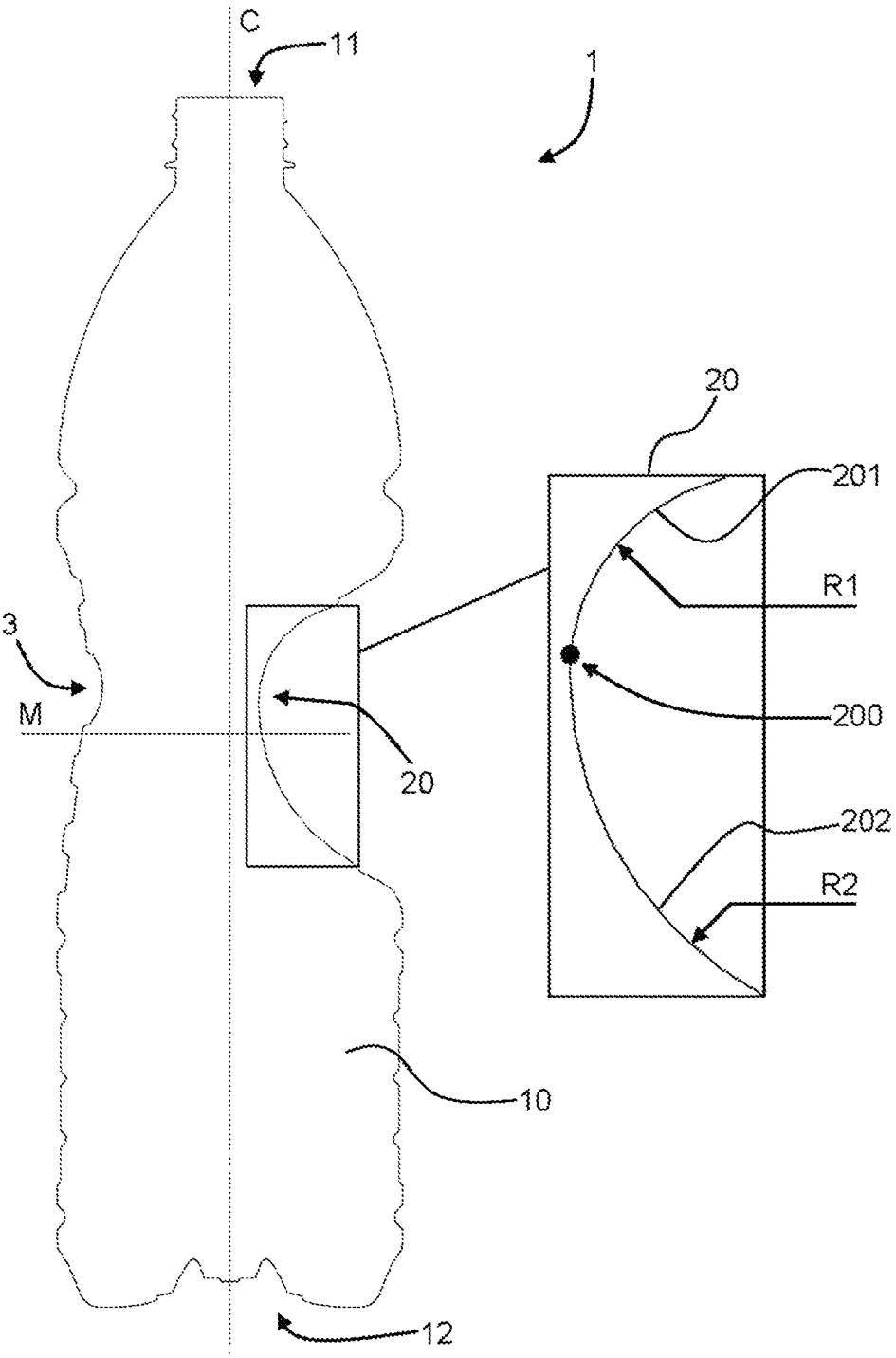

[Fig. 4]
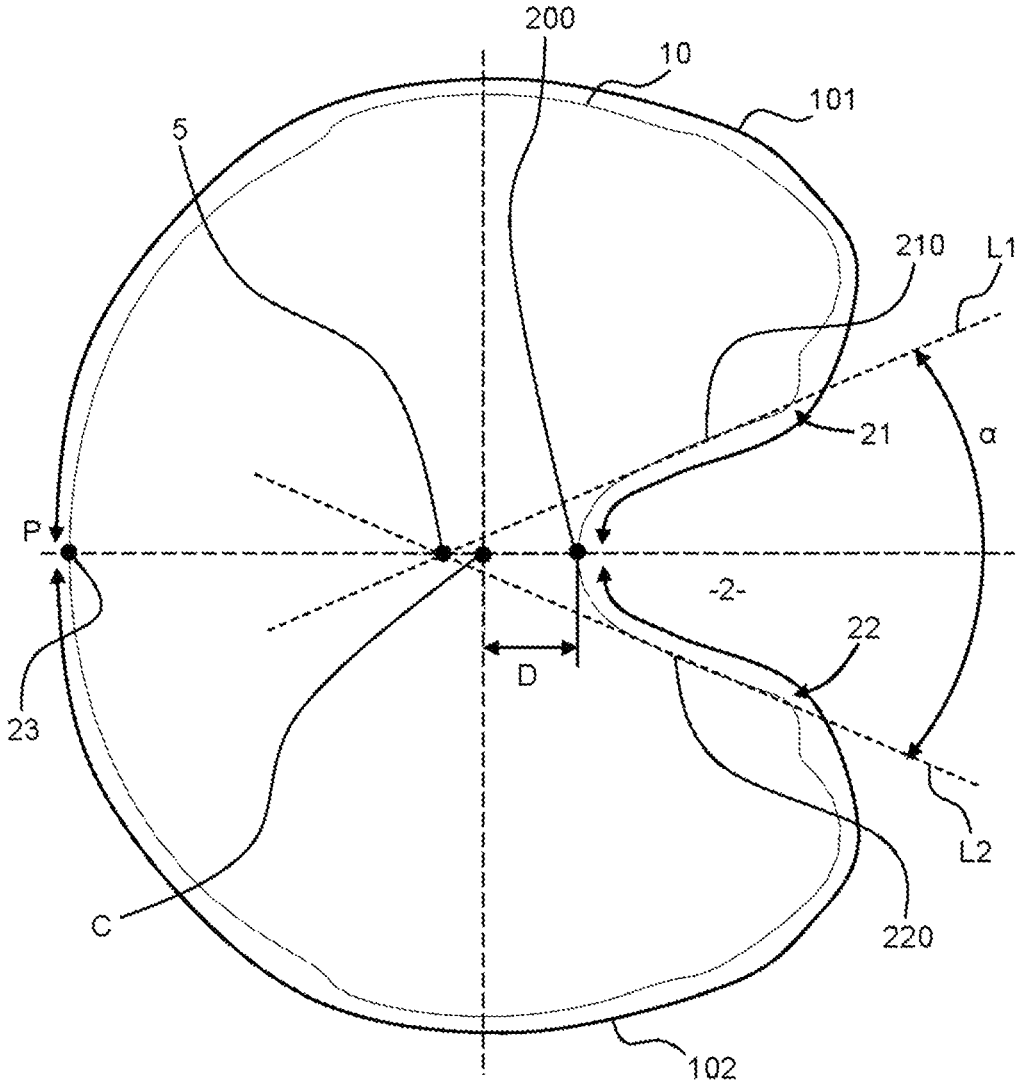

[Fig. 5]
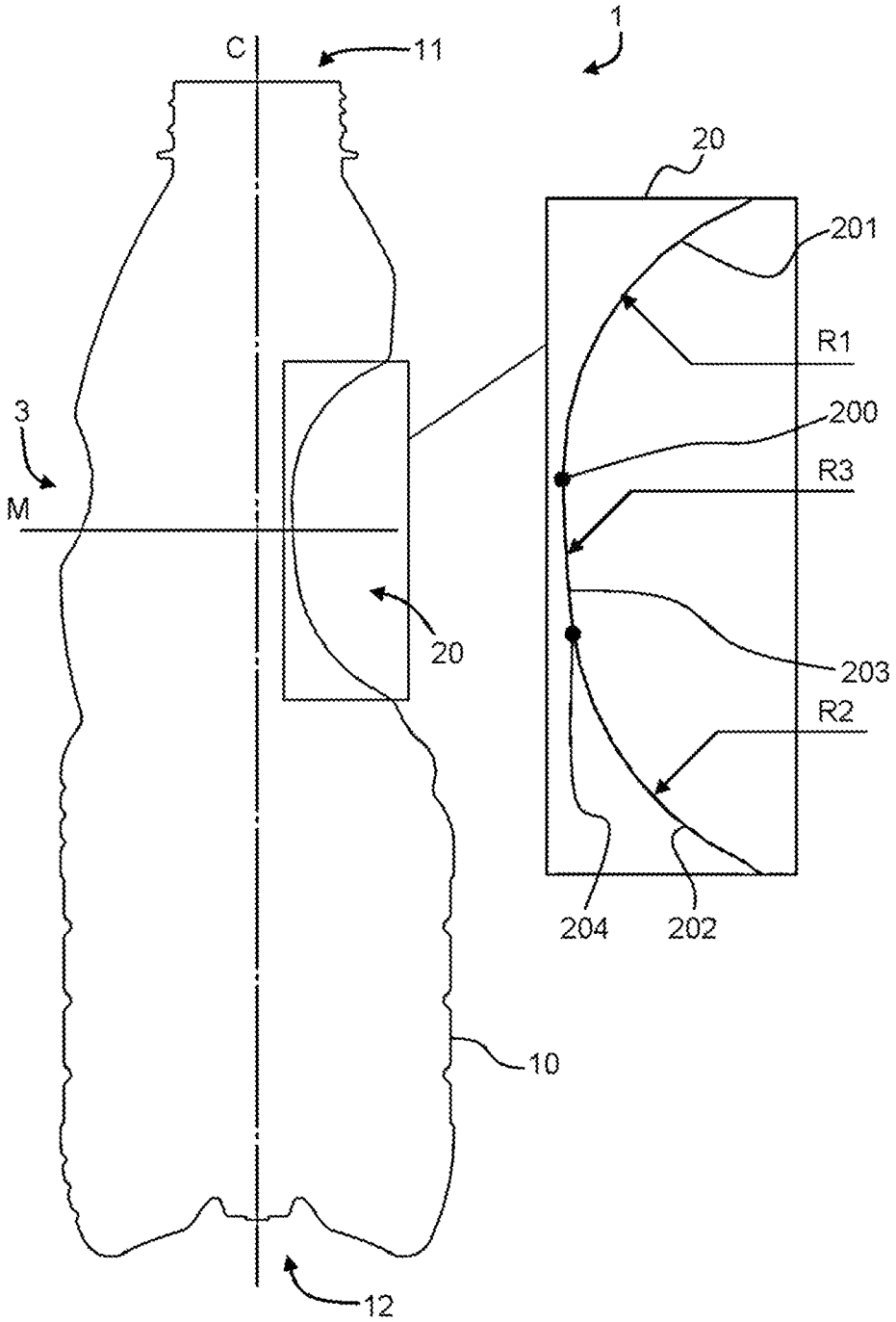

[Fig. 6]
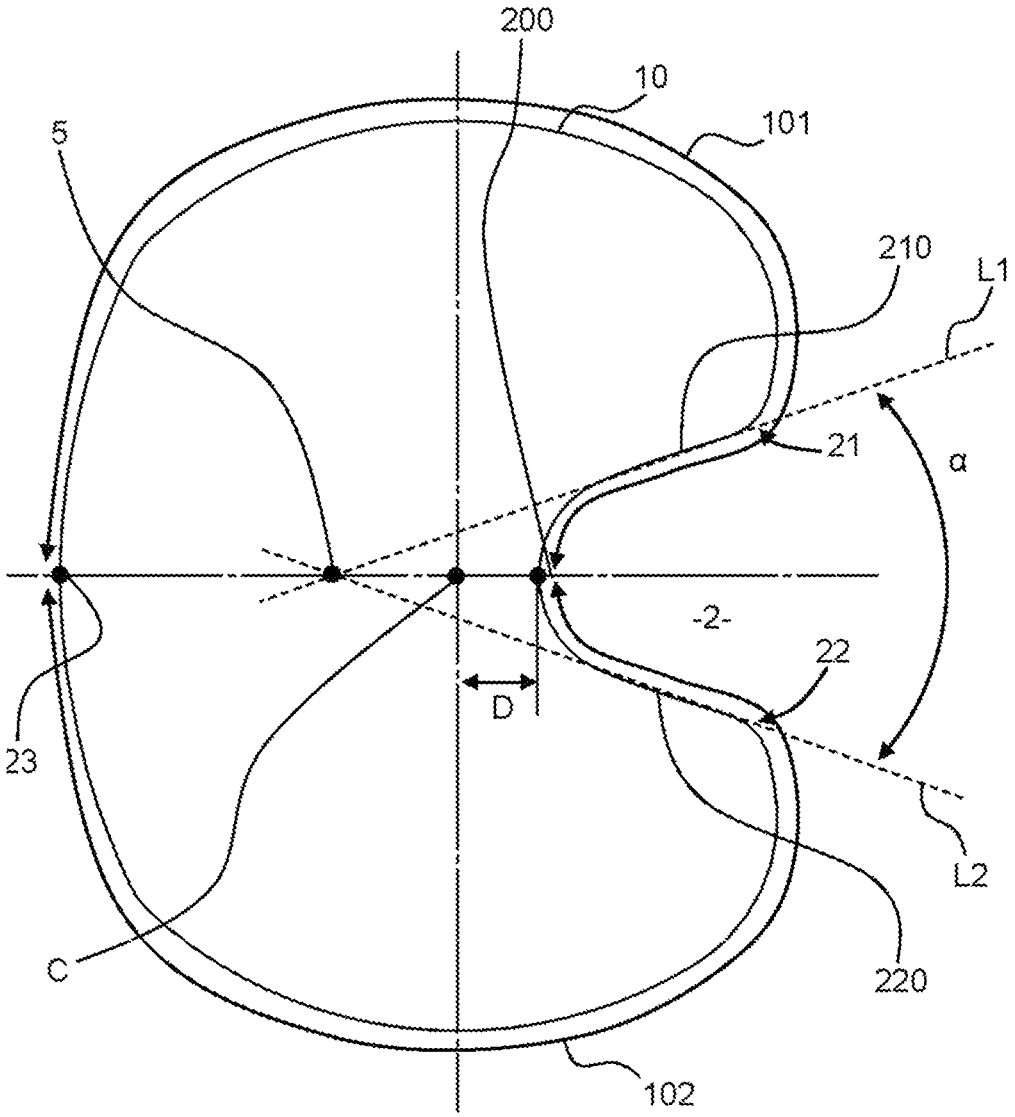

CONTAINER, THE BODY OF WHICH HAS A GRIPPING HANDLE FORMED BY A SINGLE BOXING OPERATION

The field of the invention is that of the design and manufacture of plastic containers.

More specifically, the invention concerns containers obtained by blow molding or stretch blow molding from plastic blanks (preforms, or intermediate containers having undergone one or more preliminary blow-molding operations).

The manufacture of a container by blow molding comprises a step of introducing a blank previously heated to a temperature above the glass transition temperature of the constituent material of the preform (such as PET) into a mold with the imprint of the container, and a step of injecting a pressurized fluid (such as air) into the blank. Stretching by means of a sliding rod may complete the blow molding.

A container obtained in this way has a form defined by a body that extends between a base and an opening.

It can be more or less easy to hold such containers depending on the form and the volume of the container and also the size of the hands of the person wanting to grip the container.

In order to make it easier to hold the container, it is known to produce one or more holding handles directly on the body of the container.

In this case, the handle is produced on the body of the container while the container is being formed. To that end, the mold in which the container is blow molded has inserts, referred to as inserts for overstroking a handle, which can be moved through walls of the mold.

The process for manufacturing a container with a holding handle comprises a step of overstroking a handle using the inserts. The overstroking consists in pushing a zone of material into the container, so as to form a handle in the form of a recess on the wall. The handle is formed by bringing two portions of a wall of the container close together while the container is being formed under the action of the overstroking inserts. The overstroking inserts thus deform the still-soft plastics material.

The overstroking produces a recess having a significant depth on the wall of the body. The depth of this recess cannot be obtained by solely blow molding the container in its mold.

Containers comprising an overstroked holding handle, such as those described in the patent document published under the number U.S. Ser. No. 10/086,969B2, are known from the prior art. The containers described in said document comprise a holding handle formed by two overstroked recesses of the body, which face one another and thus bring two opposite portions of the wall of the body of the container close to one another. The overstroked handle allows a person to more easily grip the container by inserting their thumb into one of the overstroked recesses, placing their hand around the handle, and inserting their other fingers into the other overstroked recess. The user can thus grip the handle in order to lift the container.

In the field of the invention, the patent document published under the number EP3112280A1 is also known. Said document describes a large-capacity container provided with a handle. The handle is formed by two overstroked recesses on the body, facing one another and located on a side of the container. The handle is thus off-center on the container so as to allow a person to insert their fingers into the overstroked recesses in order to grip the container. The recesses are overstroked symmetrically so as to allow the bottle to be held by a right hand or a left hand.

The handles described in said documents make it simpler to hold the containers. However, this type of handle design has several disadvantages.

This is because the production of such a handle causes an overconsumption of plastics material for the formation of the container. More specifically, with respect to the molding of a container without overstroking, the implementation of overstroking requires a greater quantity of plastic to allow the soft plastics material to deform well.

The result of this is thus an increase, albeit a small one, in the mass of the container, this proving undesirable and clearly in conflict with current trends in terms of saving material. For certain applications, the packaging cost of which is predominant over the total cost of the product, this increase in mass proves to be problematic.

Moreover, this double overstroking gives rise to constraints on the design of the mold used to form the container, and on the vertical position of the overstroking inserts with respect to the mold.

More specifically, when the container is being molded, the blow-molding pressure is pneumatically compensated. The blow-molding pressure corresponds to the air injected into a preform placed in the mold for producing the container. This blow-molding pressure tends to part two parts of the mold that are placed one against the other to form the mold. The pneumatic compensation consists in injecting air into a chamber formed between one of the parts of the mold and its support in order to counteract the blow-molding pressure. The chamber is delimited between the part of the mold and its support by a compensation seal. The seal is arranged so that the projected area of the compensation chamber is at least equal to that of the container considered in a plane parallel to the longitudinal axis of the container. In particular for production cost reasons, the compensation zone, which was customized in the past in the Applicant's machines, is now standard and the compensation chamber has a position and dimensions that are the same whatever the projected area of the bottle may be. For reasons linked to the design of the mold and of its support, the height of the chamber is generally less than that of the container (the height is the dimension considered along the longitudinal axis of the container) and the width of the chamber is greater such that the projected area of the chamber is at least equal to that of the container. Consequently, the base of the container, its neck and part of the shoulder face the outside of the compensation chamber.

In this context, if a double overstroking has to be implemented, the overstroking insert equipping the compensated mold part needs to move inside the perimeter defined by the compensation seal. By way of example, in one of the Applicant's projects, the overstroking insert passing through the compensated mold part needs to have a vertical position such that the shaft of the holding handle produced cannot be positioned less than 97 mm from the neck of the container.

Lastly, such a handle formed by two overstroked recesses on the body does not prove optimal for bottles with a smaller diameter. This is because the handle is not very ergonomic in definitive terms. This results from the fact that it is compulsory to reduce the back of the grip and the holding opening-out portion.

In particular, the aim of the invention is to remedy the drawbacks of the prior art.

More specifically, the aim of the invention is to provide a container having a holding handle the design of which limits the overconsumption of plastics material when the container is being manufactured, in particular in relation to the containers according to the prior art having a holding handle formed by double overstroking.

The aim of the invention is also to provide such a container that can be gripped in any way and just as easily by the right hand or the left hand of a consumer.

These aims, and others that will become apparent below, are achieved by virtue of the invention, the subject of which is a plastic container comprising a body that extends along a central axis between an opening and a base, the body having an overstroked holding recess extending parallel to the central axis over a predetermined height H, wherein the overstroked holding recess is the only overstroked recess on the body over the predetermined height, and has:

a median line of maximum indentation;

a right-hand lateral rim and a left-hand lateral rim that frame the median line of maximum indentation;

the median line of maximum indentation being able to be inscribed in a diametrical plane equidistant from the right-hand lateral rim and the left-hand lateral rim.

By virtue of the invention, the container has a holding handle composed of the very form of the body over its predetermined height H. Specifically, over this predetermined height H, the body has a single overstroked holding recess that improves the holding of the body of the container.

According to the principle of the invention, the holding handle makes it possible to "clamp" the container in order to grip it. The overstroked holding recess extends over the predetermined height and thus provides a receptacle in which at least one of the fingers of a hand (for example one or more of the fingers except for the thumb, or rather only the thumb) can be inserted. The hand can therefore close around the body of the container such that the thumb comes into opposition to the body of the container, facing the other finger(s). The clamp thus formed by the hand allows the container to be gripped effectively by a right-handed person or a left-handed person, using the single overstroked recess.

This hold is in particular ergonomic on containers that have a small diameter (less than 100 mm).

Consequently, there is no other overstroked holding recess over the predetermined height H beyond the first and only overstroked holding recess. The formation of the container therefore results in only a light overconsumption of plastics material for the formation of other overstroked holding recesses. A container according to the invention can therefore be made more lightweight than a container that has a holding handle formed by double overstroking.

Moreover, the implementation of a single overstroking for forming the holding handle offers greater flexibility in the design of the mold for the container and also increased possibilities in the design of the packaging, since the positioning range of the mobile insert is greater. This results from the fact that the overstroking insert producing the overstroked holding recess may be movable through the non-compensated part of the mold. Therefore, the overstroking insert passing through the non-compensated mold part may have a vertical position such that the holding handle produced may be located, in relation to the container, at a greater height than that allowed for containers having a holding handle formed by double overstroking, with a pneumatically compensated mold. If a comparison is made with the above-mentioned example in which it is not possible for the holding handle to have a zone located less than 97 mm from the neck of the blank, the invention makes it possible to drastically reduce this distance: the overstroked holding recess may be located much closer to the neck of the container.

It may also be noted that the formation of a holding handle using a single overstroking, and not two overstrokings, consumes less energy because only a single overstroking insert needs to be moved. Moreover, this solution, insofar as it requires only one insert in a mold (preferentially the non-compensated half-mold), is less expensive than solutions implementing double overstroking, these solutions requiring two inserts per mold (one insert in each half-mold).

According to a preferential feature, at least one deepest point of the median line of maximum indentation is located 15 mm or less from the central axis C.

The overstroked holding recess thus has a depth which is large enough for optimum insertion of the fingers of one hand, whatever the format of the bottle may be, and for allowing a hand to form a clamp on the container.

The median line of maximum indentation describes the profile of the overstroked recess in the diametrical plane. The deepest point(s) correspond(s) to that point along this median line of maximum indentation that is closest to the central axis C or which projects beyond the central axis C in the diametrical plane to the greatest extent, with respect to the other points that form the median line of maximum indentation. Therefore, if the median line of maximum indentation has, at its maximum depth, a straight section parallel to the central axis C, then the points forming this straight section are the deepest points of the median line of maximum indentation.

Advantageously, the deepest point(s) are located 5 mm or more from the central axis C.

Advantageously, the creation of the overstroked holding recess during the formation of the container by stretch blow molding does not require an unconventional adjustment of the travel of the stretch rod that serves to stretch and hold the container. More specifically, during the blow molding, the stretch rod extends into the preform along the central axis C in order to ensure that an amorphous point of the preform is well held at the base of the mold. This stretch rod thus occupies a space centered on the central axis C inside the container while it is being formed. Consequently, the position of the deepest point(s), which is 5 millimeters or more from the central axis C, avoids contact between the overstroked recess and the stretch rod. There is therefore no need to prematurely pull up the stretch rod to allow overstroking of the overstroked holding recess that may extend facing the travel of the stretch rod.

Advantageously, the body has a first opening-out portion and a second opening-out portion on either side of the diametrical plane P of the body, between said deepest point and a point diametrically opposite said deepest point, the first opening-out portion and the second opening-out portion each being from 100 to 160 millimeters.

The holding handle of the container is thus particularly ergonomic.

According to a preferred design, the body is symmetrical with respect to the diametrical plane over the predetermined height H.

By virtue of this design, the container can be gripped in any way and just as easily by the right hand or the left hand.

According to a preferential design, the overstroked holding recess has, on either side of the median line of maximum indentation, a right-hand lateral face and a left-hand lateral face which can be inscribed in a first plane and a second plane, respectively, that intersect at an opening angle of between 25° and 45°.

Such an opening in the overstroked holding recess promotes the correct insertion of at least one of the fingers of a person, whether they are right-handed or left-handed.

Below 25°, the insertion of at least one of the fingers into the overstroked recess becomes awkward, and above 45° holding the container with the aid of the handle is neither easy nor effective.

According to one advantageous feature, the body has, over its predetermined height H and along the central axis C, a cross section which can be inscribed inside a circle the diameter of which decreases from a top end of the predetermined height, then increases to a bottom end of the predetermined height.

This decrease in the diameter of the circle in which the body can be inscribed brings about a diminution of the minimum opening-out portion that is required in order for a hand to be able to grip the container.

The body therefore has more restricted dimensions over its predetermined height that make it easier for a hand to hold the container.

This is because, when a person grips the container, they insert fingers (for example, from the index finger to the little finger) into the overstroked holding recess and surround the body with the rest of their palm in order to position their thumb in opposition to the body and form a clamp. As an alternative, although this is less natural, the person can grip the container by inserting their thumb into the overstroked holding recess and surrounding the body with the rest of their palm in order to position their other fingers in opposition to the body and form a clamp.

According to a preferential solution, the body has, over its predetermined height H, a swage in which a finger can be positioned and that is diametrically opposite the overstroked holding recess and the function of which is to accommodate a finger in order to make it easier to hold the container, as explained below.

Such a positioning swage makes it easier for a hand to hold the container: specifically, tests have revealed that when the container is being held, the thumb is accommodated naturally in this positioning swage while at least one other finger is accommodated naturally in the overstroked holding recess.

Preferentially, in the case of packaging which is particularly lightweight, the body has annular reinforcing corrugations at least over its predetermined height H, the positioning swage being positioned between two annular corrugations.

The body is thus reinforced over its predetermined height H, which avoids the container being fragile on account of the presence of the positioning swage. Such a reinforcement is important in particular when the packaging requires a strength that its weight and therefore the PET thickness available do not allow it to reach.

Moreover, the positioning swage then blends into the body in visual terms.

Advantageously, in the diametrical plane and along an orthogonal projection onto the central axis C, the positioning swage is located above the halfway point of the height of the overstroked holding recess.

Holding the container is therefore even easier and more comfortable. This is because this disposition of the positioning swage with respect to the overstroked holding recess then conforms with the morphology of a hand and the motion conventionally implemented in order to grip an object.

According to an advantageous embodiment, the median line of maximum indentation is convex toward the central axis C, between a top end and a bottom end that are remote from the central axis C, the median line of maximum indentation having, in succession from the top end:

a first portion having a radius of curvature R1;

a second portion having a radius of curvature R2;

the radius of curvature R1 being less than the radius of curvature R2.

According to this embodiment, the overstroked holding recess has a profile that promotes gripping the container using the handle formed on the body. This is because, by having a radius of curvature less than that of the second portion, the first portion of the median line of maximum indentation forms a stop that is larger than that formed by the second portion. This improves the way in which the weight of the container is applied to the top part of the finger(s) that are inserted into the overstroked holding recess, which moreover corresponds logically to the profile offered by the lengths of the four fingers of the hand, except for the thumb, when they are all inserted in the overstroked recess.

According to another advantageous embodiment, the median line of maximum indentation is convex toward the central axis C, between a top end and a bottom end that are remote from the central axis C, the median line of maximum indentation having, in succession from the top end:

a first curved portion;

an essentially straight intermediate portion;

a second curved portion.

This design forms a receptacle that ergonomically receives all the fingers, except for the thumb, in the overstroked holding recess when the container is being held.

Other features and advantages of the invention will become more clearly apparent on reading the following description of two preferential embodiments of the invention, which are given by way of illustrative and nonlimiting example, and the appended drawings in which:

FIG. 1 is a perspective view of a container according to a first embodiment of the invention, illustrating the overstroked holding recess in particular;

FIG. 2 is a side view of the container according to the first embodiment of the invention, having on the overstroked holding recess and the swage in which a finger can be positioned;

FIG. 3 is a sectional view of the first embodiment of the container, along the diametrical plane, in which a central axis of the container is located;

FIG. 4 is a horizontal sectional view of the first embodiment of the container, passing through the deepest point of the median line of maximum indentation of the overstroked holding recess;

FIG. 5 is a sectional view of a second embodiment of the container, in the diametrical plane, in which a central axis of the container is located;

FIG. 6 is a horizontal sectional view of the second embodiment of the container, passing through the deepest point of the median line of maximum indentation of the overstroked holding recess.

As can be seen in FIGS. 1, 2, 3 and 5, a container 1 according to the invention comprises a body 10 which extends along a central axis C between an opening 11 and a base 12.

The opening 11 is conventionally present at the end of a neck 13 located above a shoulder 14 that surmounts the body 10.

More particularly, according to the embodiments illustrated, the container 1 is a bottle manufactured from a thermoplastic material such as PET (acronym for polyethylene terephthalate).

The container 1 has an overstroked holding recess 2. This overstroked holding recess 2 extends parallel to the central axis C over a predetermined height H.

Such an overstroked recess is produced during the manufacture of the container 1 using an overstroking insert which deforms the plastics material that was heated and blow molded beforehand in a molding cavity of a mold to the form of the container to be obtained, in that said overstroking insert penetrates into the mold.

The overstroked holding recess 2, produced using an overstroking insert, cannot be obtained solely by blow molding a preform over a determined form of a mold (for example, a protuberance projecting into the molding cavity), in particular facing the depth of the overstroked holding recess 2. This is because, as explained above, the depth of an overstroked recess is greater than the maximum depth attainable by blow molding a preform over a determined form of a mold.

According to the principle of the invention, and as is illustrated in FIGS. 3 and 5, the overstroked holding recess 2 has a median line 20 of maximum indentation.

This median line 20 of maximum indentation corresponds to the profile of the overstroking insert through the mold over the predetermined height H, and to the imprint left by the overstroking insert on the container 1.

The overstroked holding recess 2 also has a right-hand lateral rim 21 and a left-hand lateral rim 22, as is illustrated in FIG. 1. The right-hand lateral rim 21 and the left-hand lateral rim 22 frame the median line 20 of maximum indentation.

Still according to the principle of the invention and with reference to FIGS. 3 to 6, the median line 20 of maximum indentation can be inscribed in a diametrical plane P which is equidistant from the right-hand lateral rim 21 and the left-hand lateral rim 22.

This diametrical plane P corresponds to the views in FIGS. 3 and 5, and is shown in FIGS. 4 and 6.

Moreover, the overstroked holding recess 2 is the only overstroked recess on the body 10 over the predetermined height H.

That is to say that the body 10 has no other overstroking over the predetermined height H. The body 10 may, however, have other recesses which are not made by overstroking over the predetermined height H.

With reference to FIGS. 4 and 6, the deepest point 200 of the median line 20 of maximum indentation is located 5 millimeters to 15 millimeters from the central axis C of the container 1 without the overstroked holding recess 2 interfering with the central axis C.

According to the present embodiment, the deepest point 200 of the median line 20 of maximum indentation is located at a distance D of 7.5 millimeters from the central axis C.

As is illustrated in FIGS. 4 and 6, it will be understood that the overstroking insert, when this container 1 is being manufactured, is displaced along a translation axis inscribed in a median plane of the insert, intersecting the central axis C of the container.

In this way, the container 1 can be formed by stretch blow molding.

This is because, when the container is being manufactured, it is not necessary for a stretch rod to be pulled out in advance to allow the overstroked holding recess 2 to be overstroked on, or into, or through, the volume occupied by this stretch rod when it is fully pressed into the container 1.

As is illustrated in FIGS. 4 and 6, the body 10 is symmetrical with respect to the diametrical plane P over the predetermined height H.

The overstroked holding recess 2 is described in detail below with reference to FIGS. 3 to 6.

As is illustrated in FIG. 4, the overstroked holding recess 2 has an opening angle $\alpha$.

More specifically, the overstroked holding recess 2 has a right-hand lateral face 210 and a left-hand lateral face 220 on either side of the median line 20 of maximum indentation.

The right-hand lateral face 210 can be inscribed in a first plane L1 and the left-hand lateral face 220 can be inscribed in a second plane L2.

The first plane L1 and the second plane L2 intersect at the opening angle $\alpha$ which is between 25° and 45°, and more preferentially from 30° to 40°. This opening angle $\alpha$ is measured in a plane orthogonal to the central axis C.

According to the embodiment illustrated in FIG. 4, the opening angle $\alpha$ is equal to 35°. According to the embodiment illustrated in FIG. 6, the opening angle $\alpha$ is equal to 37°.

With reference to FIGS. 2, 4 and 6, the first plane L1 and the second plane L2 intersect in a plane orthogonal to the central axis C and over the predetermined height H at a meeting point 5.

This meeting point 5 is located behind the central axis C with respect to the overstroked holding recess 2.

This meeting point 5 is also located in the diametrical plane P.

As is illustrated in FIGS. 3 and 5, the median line 20 of maximum indentation is convex toward the central axis C, between a top end and a bottom end that are remote from the central axis C.

In other words, the median line 20 of maximum indentation is curved between its top and bottom ends in such a way that a central part of this median line 20 of maximum indentation is closer to the central axis C than said ends.

As is illustrated by the detail in FIG. 3, and according to the first embodiment, the median line 20 of maximum indentation has:

a first portion 201;

a second portion 202.

The first portion 201 extends from the top end of the median line 20 of maximum indentation to the deepest point 200 of the median line 20 of maximum indentation.

For its part, the second portion 202 extends from the first portion 201, in particular from the deepest point 200, to the bottom end of the median line 20 of maximum indentation.

The first portion 201 has a radius of curvature R1, and the second portion 202 has a radius of curvature R2.

As is illustrated in FIG. 3, the radius of curvature R1 is less than the radius of curvature R2.

This design displaces the deepest point 200 of the median line 20 of maximum indentation above the halfway point M of the height of the overstroked holding recess 2, that is to say toward the opening 11 in the container.

As is illustrated by the detail in FIG. 5, and according to the second embodiment, the median line 20 of maximum indentation has:

a first portion 201;

a second portion 202;

an intermediate portion 203.

The first portion 201 extends from the top end of the median line 20 of maximum indentation to the deepest point 200 of the median line 20 of maximum indentation.

The intermediate portion 203 extends from the first portion 201, in particular from the deepest point 200, to an intermediate point 204 along the median line 20 of maximum indentation.

For its part, the second portion 202 extends from the intermediate portion 203, in particular from the intermediate point 204, to the bottom end of the median line 20 of maximum indentation.

The first portion 201 has a radius of curvature R1, the second portion 202 has a radius of curvature R2, and the intermediate portion 203 has a radius of curvature R3.

As is illustrated in FIG. 5, the radius of curvature R1 and the radius of curvature R2 are such that the first portion 201 and the second portion 202 have a significant curvature, and are therefore curved.

The intermediate portion 203 is essentially straight. Specifically, the radius of curvature R3 is large enough that the intermediate portion 203 can be likened to a straight line.

With reference to FIGS. 1 to 3, the body 10 has, on its predetermined height H and along the central axis C, a cross section, as shown in FIG. 4, which can be inscribed inside a circle.

Preferably, over the predetermined height H, the diameter of the circle decreases from a top end of the predetermined height H, that is to say toward the opening 11 in the container 1, then, after having reached a predetermined minimum diameter, increases to a bottom end of the predetermined height H, that is to say toward the base 12 of the container 1.

In other words, when there is such a decrease in the diameter, the container 1 has a thinning over its predetermined height H.

As is illustrated in FIGS. 1, 2, 3 and 5, the body 10 has, over its predetermined height H, a swage 3 in which a finger can be positioned.

This positioning swage 3 is diametrically opposite the overstroked holding recess 2.

This positioning swage 3 is obtained by virtue of the form of the cavity of the mold.

More specifically, the positioning swage 3 is obtained by the blow molding of the plastics material, while the container 1 is being produced, and thus by the application of the plastics material against the surface of the mold, which has a complementary form to that of the container 1 illustrated in FIG. 3.

The positioning swage 3 is substantially smooth.

As is illustrated in FIGS. 1, 2 and 3, the body 10 may have annular reinforcing corrugations 4, distributed evenly over its height. These annular reinforcing corrugations 4 are present in particular over the predetermined height H.

As is illustrated in FIGS. 1, 2 and 3, the annular reinforcing corrugations 4 over the predetermined height H may be configured in such a way that the positioning swage 3 is positioned between two adjacent annular corrugations 4.

This is because, above the positioning swage 3, the annular corrugations 4 extend with upward orientation from the overstroked holding recess 2, and, below the positioning swage 3, the annular corrugations 4 extend with downward orientation from the overstroked holding recess 2.

The two annular corrugations 4 framing the overstroked holding recess 2 are thus spaced apart from one another at the positioning swage 3.

With reference to FIG. 3, in the diametrical plane P and along an orthogonal projection onto the central axis C, the positioning swage 3 is located above the halfway point M of the height of the overstroked holding recess 2.

Such a container 1 according to the invention is more ergonomic when the bottle is held in the hand by virtue of the presence of the overstroked holding recess 2 and the swage 3 in which a finger can be positioned.

This is because, when the container is gripped using a hand, the user's fingers, except for the thumb, are naturally inserted into the overstroked holding recess 2. The thumb of the hand is then oriented toward the opening 11 in the container. Therefore, the position of the positioning swage 3, above the halfway point M of the height of the overstroked holding recess 2, supports a natural positioning of the thumb for clamping the bottle.

With reference to FIGS. 4 and 6, the body 10 has a first opening-out portion 101 and a second opening-out portion 102 on either side of the diametrical plane P of the body 10.

The first opening-out portion 101 and the second opening-out portion 102 correspond to the perimeter of the body 10, in a plane orthogonal to the central axis C, between the deepest point 200 and a point 23 that is diametrically opposite the deepest point 200.

The lengths of the first opening-out portion 101 and of the second opening out portion 102 are each between 100 and 160 millimeters.

According to the embodiments illustrated in FIGS. 4 and 6, the first opening-out portion 101 and the second opening-out portion 102 are equal given that the body 10 is symmetrical with respect to the diametrical plane P over the predetermined height H.

With reference to the first embodiment illustrated in FIG. 4, the first opening-out portion 101 and the second opening-out portion 102 are equal to 126 millimeters.

With reference to the second embodiment illustrated in FIG. 6, the first opening-out portion 101 and the second opening-out portion 102 are equal to 140 millimeters.

Such holding opening-out portions allow containers to be held well by hands of different dimensions.

The invention claimed is:

1. A blow-molded plastic container (1) comprising a body (10) that extends along a central axis (C) between an opening (11) and a base (12), the body (10) having an overstroked holding recess (2) extending parallel to the central axis (C) over a predetermined height (H), wherein the overstroked holding recess (2) is the only overstroked recess on the body (10) over the predetermined height (H), and has:

a median line (20) of maximum indentation;

a right-hand lateral rim (21) and a left-hand lateral rim (22) that frame the median line (20) of maximum indentation;

the median line (20) of maximum indentation being able to be inscribed in a diametrical plane (P) equidistant from the right-hand lateral rim (21) and the left-hand lateral rim (22);

wherein the body (10) has a first opening-out portion (101) and a second opening-out portion (102) on either side of the diametrical plane (P) of the body (10), between a deepest point (200) and a point (23) diametrically opposite said deepest point (200), the lengths of the first opening-out portion (101) and of the second opening-out portion (102) each being from 100 to 160 millimeters; and wherein the overstroked holding recess (2) has, on either side of the median line (20) of maximum indentation, a right-hand lateral face (210) and a left-hand lateral face (220) which can be inscribed in a first plane (L1) and a second plane (L2), respectively, that intersect at an opening angle of between 25° and 45°, wherein the overstroke holding recess defines a concavity.

2. The container (1) as claimed in claim 1, wherein at least one deepest point (200) of the median line (20) of maximum indentation is located 15 millimeters or less from the central axis (C).

3. The container (1) as claimed in claim 2, wherein the deepest point(s) (200) are/is located 5 millimeters or more from the central axis (C).

4. The container (1) as claimed in claim 1, wherein the body (10) is symmetrical with respect to the diametrical plane (P) over the predetermined height (H).

5. The container (1) as claimed in claim 1, wherein the body (10) has, over its predetermined height (H) and along the central axis (C), a cross section which can be inscribed inside a circle the diameter of which decreases from a top end of the predetermined height (H), then increases to a bottom end of the predetermined height (H).

6. The container (1) as claimed in claim 1, wherein the body (10) has, over its predetermined height (H), a swage (3) in which a finger can be positioned, the positioning swage (3) being diametrically opposite the overstroked holding recess (2).

7. The container (1) as claimed in claim 6, wherein the body (10) has annular reinforcing corrugations at least over its predetermined height (H), the positioning swage being positioned between two annular corrugations.

8. The container (1) as claimed in claim 6, wherein, in the diametrical plane (P) and along an orthogonal projection onto the central axis (C), the positioning swage (3) is located above the halfway point (M) of the height of the overstroked holding recess (2).

9. The container (1) as claimed in claim 1, wherein the median line (20) of maximum indentation is convex toward the central axis (C), between a top end and a bottom end that are remote from the central axis (C), the median line (20) of maximum indentation having, in succession from the top end:

a first portion (201) having a radius of curvature R1;

a second portion (202) having a radius of curvature R2;

the radius of curvature R1 being less than the radius of curvature R2.

10. The container (1) as claimed in claim 1, wherein the median line (20) of maximum indentation is convex toward the central axis (C), between a top end and a bottom end that are remote from the central axis (C), the median line (20) of maximum indentation having, in succession from the top end:

a first curved portion (201);

an essentially straight intermediate portion (203);

a second curved portion (202).

11. The container (1) as claimed in claim 2, wherein the body (10) is symmetrical with respect to the diametrical plane (P) over the predetermined height (H).

12. The container (1) as claimed in claim 3, wherein the body (10) is symmetrical with respect to the diametrical plane (P) over the predetermined height (H).

13. The container (1) as claimed in claim 2, wherein the body (10) has, over its predetermined height (H) and along the central axis (C), a cross section which can be inscribed inside a circle the diameter of which decreases from a top end of the predetermined height (H), then increases to a bottom end of the predetermined height (H).

14. The container (1) as claimed in claim 3, wherein the body (10) has, over its predetermined height (H) and along the central axis (C), a cross section which can be inscribed inside a circle the diameter of which decreases from a top end of the predetermined height (H), then increases to a bottom end of the predetermined height (H).

15. The container (1) as claimed in claim 7, wherein, in the diametrical plane (P) and along an orthogonal projection onto the central axis (C), the positioning swage (3) is located above the halfway point (M) of the height of the overstroked holding recess (2).

16. The container as claimed in claim 1, wherein the overstroked holding recess is sized and shaped so as to permit standard operation of a stretch rod used in a stretch blow molding process of manufacturing the container.

17. The container as claimed in claim 1, wherein the overstroked holding recess (2) defines a receptacle for which one or more fingers of a hand can be at least partially inserted therein.

18. A stretch blow-molded plastic container (1) comprising a body (10) that extends along a central axis (C) between an opening (11) and a base (12), the body (10) having an overstroked holding recess (2) extending parallel to the central axis (C) over a predetermined height (H), wherein the overstroked holding recess (2) is the only overstroked recess on the body (10) over the predetermined height (H), and has:

a median line (20) of maximum indentation;

a right-hand lateral rim (21) and a left-hand lateral rim (22) that frame the median line (20) of maximum indentation;

the median line (20) of maximum indentation being able to be inscribed in a diametrical plane (P) equidistant from the right-hand lateral rim (21) and the left-hand lateral rim (22);

wherein the body (10) has a first opening-out portion (101) and a second opening-out portion (102) on either side of the diametrical plane (P) of the body (10), between a deepest point (200) and a point (23) diametrically opposite said deepest point (200), the lengths of the first opening-out portion (101) and of the second opening-out portion (102) each being from 100 to 160 millimeters; and wherein the overstroked holding recess (2) has, on either side of the median line (20) of maximum indentation, a right-hand lateral face (210) and a left-hand lateral face (220) which can be inscribed in a first plane (L1) and a second plane (L2), respectively, that intersect at an opening angle of between 25° and 45°, the overstroked holding recess (2) defining a concavity for which one or more fingers of a hand can be at least partially inserted within during the gripping thereof.

* * * * *